US005713658A

United States Patent [19]

Stranagan, Jr.

[11] Patent Number: 5,713,658

[45] Date of Patent: Feb. 3, 1998

[54] ADJUSTABLE DROP LIGHT HANGER

[76] Inventor: Maurice J. Stranagan, Jr., 57 Magnolia St., Bergenfield, N.J. 07621

[21] Appl. No.: 661,701

[22] Filed: Jun. 11, 1996

[51] Int. Cl.[6] ..... F21V 19/02

[52] U.S. Cl. ..... 362/220; 362/396; 362/427; 248/215; 248/324

[58] Field of Search ..... 248/214, 215, 248/229.25, 228.6, 231.71, 313, 316.7, 324; 362/217, 220, 396, 287, 269, 418, 427, 429

[56] References Cited

U.S. PATENT DOCUMENTS

| | | | |
|---|---|---|---|
| 1,349,312 | 8/1920 | Barrett | 362/396 |
| 1,363,664 | 12/1920 | Livingston | 362/396 |
| 1,518,824 | 12/1924 | Smith | 248/308 |
| 1,888,723 | 11/1932 | Gould | 362/396 |
| 2,524,173 | 10/1950 | Peterson | 362/396 |
| 2,800,573 | 7/1957 | Hudson | 362/396 |
| 3,328,577 | 6/1967 | Pistey et al. | 439/240 |
| 3,489,890 | 1/1970 | Anderson et al. | 439/241 |
| 3,685,003 | 8/1972 | Watt | 439/237 |
| 4,676,465 | 6/1987 | Myotte | 362/396 |
| 5,438,494 | 8/1995 | Harlan | 362/396 |

*Primary Examiner*—Alan Cariaso
*Attorney, Agent, or Firm*—Terrance L. Siemens

[57] ABSTRACT

A hanger for holding a fluorescent drop light at a desired orientation or angle. The hanger holds the tubular lamp of a drop light by a clip. A hook for suspending the hanger adjustably attaches to the clip. The attachment apparatus includes a base surface having angularly displaced radiating slots for partially surrounding the rod stock of the hook, a threaded stud projecting from the base surface, and a threaded nut. The slots are preferably displaced in forty-five degree increments. The hook has an eye which is slipped over the threaded stud prior to tightening the nut. The hook is secured at a desired orientation by tightening the nut when a straight portion of the hook partially occupies one of the slots. The hook can be secured vertically, horizontally, or in an intermediate orientation depending upon which slot engages the straight section of the hook.

5 Claims, 1 Drawing Sheet

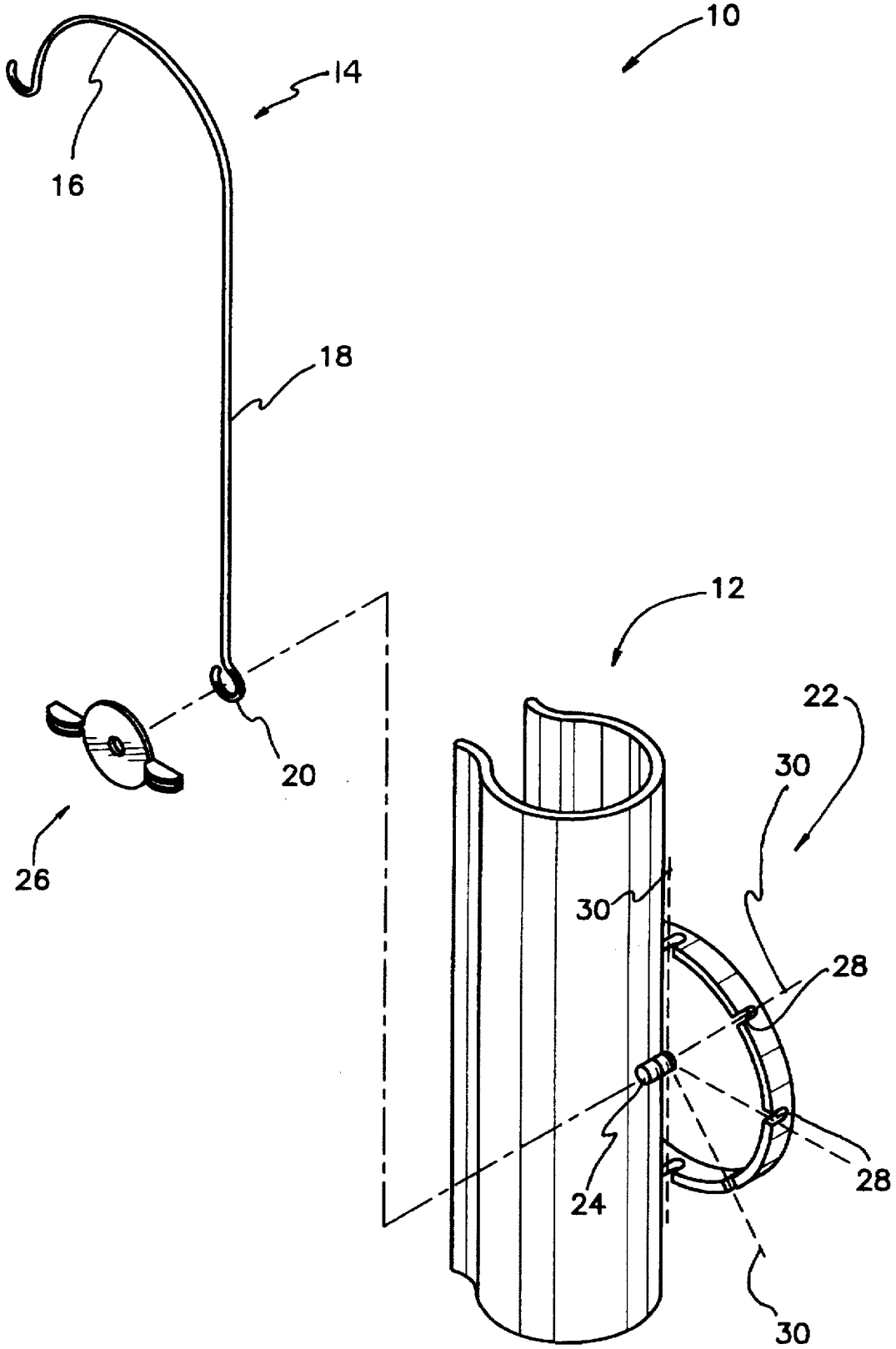
10
14
16
18
12
22
30
20
26
30
28
24
28
30

ADJUSTABLE DROP LIGHT HANGER

BACKGROUND OF THE INVENTION

1. Field of the Invention

The present invention relates to a device for suspending a tubular light bulb while maintaining the light bulb at a desired predetermined orientation. The device has a hook for suspending from a supporting environmental element, a clip for engaging the light bulb, and apparatus for maintaining the clip at a desired angle or orientation to the hook.

2. Description of the Prior Art

Since the advent of electric lamps, it has become common practice to employ suspended work lights. Such work lights typically include a lamp, lampholder having electrical contacts and usually a switch, and a hook for suspending the work light from a convenient environmental object. This arrangement enables a person to suspend a light source temporarily in close proximity to work being performed.

A typical project requiring such a light includes repairs to buildings, such as minor structural carpentry, plumbing, and electrical work, or repairs or assembly being performed on motor vehicles, boats, and similar vehicles. These projects are representative of those requiring a person to perform work away from a work table or bench, or any other facility normally provided with adequate lighting. The work usually involves an object too large to be readily moved by one person, requiring instead that the worker move into close proximity to the work. Necessary tools and materials must frequently be placed conveniently for access while working.

Large objects are frequently not provided with lighting, and a temporary light, such as a drop light, must be employed. Drop lights typically have provision for being suspended from a convenient projecting rod, cavity, strut, or similar member formed in the workpiece. To accommodate a wide variety of situations, drop lights have hooks which are pivotally attached to the light. This arrangement enables lights to be suspended in most cases, but does not assure that the light be appropriately directed.

Desk lamps having manually bendable necks which maintain a configuration until subsequently bent are known. However, these lamps usually have relatively heavy bases for resting on an environmental surface. Moreover, the length of the neck may prove unwieldy in tight quarters.

Fluorescent lamps have gained favor in all sorts of applications because of their relative economy of operation, their lack of excessive brilliance which could easily interfere with work in close quarters, and because they do not generate as much heat as incandescent lamps. It has therefore become desirable to employ fluorescent lamps as work lamps.

Although fluorescent lamps have the advantages listed above, they lack luminous intensity of incandescent lamps. A fluorescent work light is therefore more likely required to be positioned advantageously for bringing its relatively limited light to bear on the work. There exists a need for a suspensible lamp hanger which has the ability to orient a fluorescent lamp appropriately for the type of task described above.

Fluorescent lamps cannot, of course be utilized apart from a holder which supplies electrical power to the lamp. Examples are seen in U.S. Pat. Nos. 3,328,577, issued to John M. Pistey et al. on Jun. 27, 1967, 3,489,890, issued to Paul E. Anderson et al. on Jan. 13, 1970, and 3,685,003, issued to Kenneth E. Watt on Aug. 15, 1972. These devices secure a tubular fluorescent bulb and its associated prongs in contact with electrical conductors, and further enable attachment of the lamp to a larger supporting device.

The above holders enable insertion of a tubular lamp into a position making electrical contact with energized components of the holder. However, these devices lack both a hook for suspending the lamp assembly from a convenient environmental object and apparatus for maintaining the tubular lamp at a desired orientation.

Drop lights employing fluorescent lamps are known, but are usually provided with a hook solidly fixed to the lamp, thereby enabling only one orientation of the lamp.

U.S. Pat. No. 1,518,824, issued to Margaret J. Smith on Dec. 9, 1924, illustrates an arrangement for securing a hook selectively in any of several angular positions by frictional engagement with a groove. This concept is expanded upon in the present invention by more secure locking apparatus. Also, the Smith device is intended to be used with curtains, and bears no working relationship to lighting.

None of the above inventions and patents, taken either singly or in combination, is seen to describe the instant invention as claimed.

SUMMARY OF THE INVENTION

The present invention provides an improved, convenient, readily fastened and adjusted hanger for suspending a fluorescent light assembly in the manner of a conventional drop light provided with a hook. The improvement is that orientation of the tubular fluorescent lamp may be oriented as desired, within the limits of adjustment, with respect to a vertical direction. Known fluorescent drop lights are typically provided with a cap secured to one end of the tube. A hook formed integrally with this cap enables the light assembly to be suspended from an environmental object. However, the lamp must hang vertically, or in any predetermined orientation depending upon the relationship of the hook to the cap.

Since it is frequently desired to vary this orientation, ability to suspend the light by the hook originally provided integrally therewith must be surrendered. Thus the user is obliged to support the lamp in a suitable manner while assuring the desired orientation. The present invention solves this problem by an adjustable clamp which secures the hook to the lamp.

The invention comprises a resilient clip which engages the tubular fluorescent lamp in a manner similar to that of clips frequently employed to hold cartridge fuses. The clamp is secured to the clip. The hook is adjustably positioned as desired relative to the clip, and is solidly clamped in the desired position. The fluorescent lamp is adequately suspended by the hook, while simultaneously held at an appropriate or advantageous angle for directing light onto the work at hand.

The clamp is formed integrally with the clip, or is solidly fixed thereto. The hook forms an eye at its distal end. This eye is passed over a stud forming part of the clamp. When a nut is threaded onto the stud, the hook is securely attached to the clamp, and hence to the clip.

The clamp is preferably castellated, having slots which cooperate closely with a straight section of the hook. The clamp thereby does not rely solely upon tightness of the nut for engaging the hook.

The novel hanger cooperates with commercially available fluorescent drop lights, and indeed may be connected to any light assembly or device having a tubular member which may be grasped by the clip. The advantages recited regarding fluorescent lamps may be enjoyed, the novel hanger requiring only minimal effort to attach. The hanger is uncomplicated and inexpensive, and enables a fluorescent lamp to be employed in the manner intended, while enabling light to be advantageously directed or the lamp to be located out of the way.

Accordingly, it is a principal object of the invention to provide a hanger for enabling a tubular fluorescent lamp to be oriented at a desired angle or orientation when suspended.

It is another object of the invention to enable adjustment of the selected angle or orientation.

It is a further object of the invention to cooperate with existing or commercially available fluorescent drop lights.

Still another object of the invention is to enable ready, resilient engagement of a tubular object.

An additional object of the invention is to assure secure engagement of the hook to the clip.

It is again an object of the invention to provide a clamp employing a threaded fastener for tightening.

Yet another object of the invention is to assure secure engagement of the hook at each selectable position or orientation.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWING

Various other objects, features, and attendant advantages of the present invention will become more fully appreciated as the same becomes better understood when considered in conjunction with the accompanying drawing, which is an exploded, perspective view of the invention.

DETAILED DESCRIPTION OF THE PREFERRED EMBODIMENTS

Turning now to the drawing figure, novel hanger 10 comprises a resilient clip 12 and a hook 14. Clip 12 preferably has a mainly cylindrical body and a spread mouth for guiding a tubular object (not shown) into intimate engagement of the cylindrical body. Clip 12 may be formed from sheet metal stock, as this material imparts both resilience and requisite strength. Resilience both enables ready engagement of a tubular object, and also allows the cylindrical body to adjust for tubular objects of different diameters. Thus hanger 10 need not be fabricated with anticipation of the exact diameter of those tubular objects with which it is intended to cooperate.

Hook 14 has three principal sections. One is a relatively large curved section 16 for encircling or engaging an environmental object or aperture (not shown). The second section is straight section 18. Finally, straight section 18 terminates in an eye 20, the significance of which will be discussed hereinafter. Hook 14 is easily formed by bending wire stock. Hook 14 is an open hook, in that it lacks structure which, if present, would obstruct access to curved section 16.

Returning to clip 12, it is seen that a tab 22 projects to the exterior of the cylindrical body of clip 12, preferably away from the open or spread mouth of clip 12. Tab 22 is solidly attached to clip 12, thereby providing a base surface for a clamp which is solidly fixed to clip 12. One construction resulting in solid attachment of tab 22 to clip 12 would be to form both from a single sheet of metal preconfigured for this construction, folding tab 22 flat and forming tab 22 from a double thickness of sheet stock.

A threaded stud 24 projects from the base surface of tab 22. Stud 24 has a diameter dimension of magnitude less than that of the internal diameter dimension of eye 20 of hook 14. Stud 24 is passed through eye 20 and clamped against the base surface of tab 22 by a threaded wing nut 26.

A wing nut is preferred since this form of nut integrally incorporates structure enabling ready grasping of nut 26 As a consequence, no tool is required to tighten and slacken nut 26, as would possibly be required given a hexagonal nut or other nut lacking the wings of wing nut 26.

It should further be noted that this construction locates wing nut 26 away from direct contact with the lamp (not shown). This is desirable when utilizing hanger 10 to hold an incandescent tubular lamp, or any other device generating significantly more heat than is generated by a fluorescent lamp.

Examination of tab 22 will reveal that the periphery of tab 22 semicircular and is castellated, or upturned and having slots 28 formed therein. Slots 28 are thereby disposed at a predetermined orientation relative to clip 12. Specifically, slots 28 are aligned with the body of clip 12 such that one slot 28 is vertically oriented when clip 12 is vertically oriented. Additional slots 28 are provided, each angularly displaced from its neighboring slot 28 in angular increments of forty-five degrees. The plurality of slots 28 enables adjustment in securing hook 14 to clip 10 at a predetermined orientation.

The angle of the increments is defined between each two adjacent lines 30 passing through and radiating from stud 24. Lines 30 correspond to selectable positions in which straight sections 18 of hook 14 may be clamped. Clamping is performed by passing stud 24 through eye 20 of hook 14, placing straight section 18 of hook 14 in a selected slot 28, then tightening nut 26 onto stud 24. Section 18 of hook 14 is partially surrounded by slot 28, and engagement of hook 14 is completed upon tightening nut 26 over eye 20.

Hanger 10 is secured to a tubular lamp (not shown) by merely passing the lamp into clip 12. An appropriate slot 28 is then selected, first considering the desired angle or orientation of the tubular lamp. Wing nut 26 is then tightened over stud 24, entrapping and clamping eye 20 as described above. The fluorescent light assembly may be readily switched on and off as desired, since the novel hanger may be positioned away from the switch.

It will occur to those of skill in the art that many modifications and variations to hanger 10 may be made without departing from the spirit of the invention. Some of these will be discussed.

It would be possible to modify the clamp such that stud 24 were formed integrally with hook 14, thereby eliminating eye 20. In this case, the new stud (not shown) would be arranged to project from straight section 18 of hook 14 at an angle, preferably a right angle. It would also be possible to provide a winged bolt (not shown) in place of wing nut 26, so that stud 24 would be eliminated. Instead, tab 22 would have a threaded hole (not shown). It would also be possible to eliminate castellated construction of tab 22, substituting instead a series of radiating grooves (not shown) formed in the base surface of tab 22. In each of these variations, entrapment of hook 14 would be generally similar to the principal embodiment more fully described above.

Also, the number, spacing, and angular arrangement of slots 28 may be varied from the scheme described above.

It is to be understood that the present invention is not limited to the embodiments described above, but encompasses any and all embodiments within the scope of the following claims.

I claim:

1. A hanger for maintaining a tubular lamp at a predetermined orientation, comprising:

a clip for engaging the tubular lamp, said clip comprising a resilient, mainly cylindrical body, said clip having a spread mouth for radially guiding a tubular object into engagement with said cylindrical body;

a wire hook having a relatively large curved section and a straight section for suspending said hanger from an environmental object, said hook being an open hook having a straight section; and adjustment means for securing said hook to said clip at a predetermined orientation of said hook to said clip and for adjusting the predetermined orientation of said hook to said clip, said adjustment means comprising a semicircular, castellated member having a plurality of angularly displaced slots for partially surrounding said straight section of said hook, said castellated member solidly attached to said clip and projecting from said clip away from said spread mouth of said clip, said slots thereby being disposed at a predetermined orientation relative to said clip, said castellated member arranged to maintain said straight section of said hook in one of said slots when said adjustment means are adjusted.

2. The hanger according to claim 1, said adjustment means comprising a clamp for clamping said hook to said clip.

3. The hanger according to claim 2, said clamp comprising base surface, a threaded stud projecting from said base surface, and a threaded nut for tightening onto said stud, whereby said hook is entrapped between and clamped by said base surface and said nut.

4. The hanger according to claim 3, said hook further comprising an eye having an internal diameter dimension greater in magnitude than the diameter of said stud, whereby said hook is retained on said stud by passing said stud through said eye of said hook.

5. A hanger for maintaining a tubular lamp at a predetermined orientation, comprising:

a resilient clip for engaging the tubular lamp;

a hook for suspending said hanger from an environmental object, said hook having a straight section and an eye formed therein, said eye having an internal diameter dimension; and adjustment means for securing said hook to said clip at a predetermined orientation of said hook to said clip and for adjusting the predetermined orientation of said hook to said clip, said adjustment means comprising a clamp having a base surface solidly fixed to said clip, a threaded stud projecting from said base surface, said threaded stud having a diameter dimension of magnitude less than that of said internal diameter dimension of said eye of said hook, and a threaded nut for tightening onto said stud, said base surface having means defining a plurality of angularly displaced slots disposed to radiate from said stud, for engaging said hook, whereby said hook is clamped into one of said slots when said straight section of said hook is placed in one of said slots and said nut is tightened over said hook.

* * * * *